United States Patent [19]

Pillard

[11] 4,002,297

[45] Jan. 11, 1977

[54] BURNERS OF LIQUID FUELS ATOMIZED BY THE EXPANSION OF A COMPRESSED AUXILIARY FLUID

[75] Inventor: Jean-Claude L. Pillard, Marseille, France

[73] Assignee: Entreprise Generale de Chauffage Industriel Pillard, Marseille, France

[22] Filed: Oct. 9, 1975

[21] Appl. No.: 621,153

[30] Foreign Application Priority Data

Oct. 24, 1974 France ..... 74.41031

[52] U.S. Cl. ..... 239/429; 239/432; 239/433

[51] Int. Cl.[2] ..... B05B 7/04; B05B 7/08

[58] Field of Search ..... 239/419.3, 429–434, 239/434.5, 424.5, 422

[56] References Cited

UNITED STATES PATENTS

| | | | |
|---|---|---|---|
| 1,492,635 | 5/1924 | Jenkins | 239/430 X |
| 1,516,486 | 11/1924 | Anderson | 239/433 |
| 2,238,806 | 4/1941 | Doubledent | 239/432 X |
| 2,371,970 | 3/1945 | Marra | 239/424.5 X |
| 2,414,459 | 1/1947 | Fletcher | 239/429 X |
| 3,452,933 | 7/1969 | Hakluytt | 239/434 X |

FOREIGN PATENTS OR APPLICATIONS

| | | | |
|---|---|---|---|
| 218,159 | 11/1961 | Austria | 239/422 |
| 224,423 | 4/1969 | U.S.S.R. | 239/419.3 |

*Primary Examiner*—Robert S. Ward, Jr.
*Attorney, Agent, or Firm*—Brooks, Haidt, Haffner & Delahunty

[57] ABSTRACT

A burner of atomized liquid fuel comprising, in addition to the fuel admission conduit, several supplementary annular conduits fed with an auxiliary liquid such as a liquid effluent, water or a replacement fuel, which conduits communicate by channels with the mixing chambers contained in the nose of the burner.

7 Claims, 10 Drawing Figures

FIG. 1
PRIOR ART
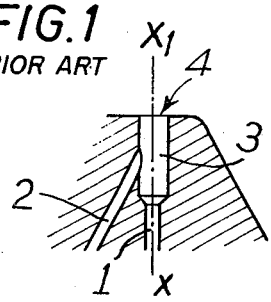
FIG. 2
PRIOR ART
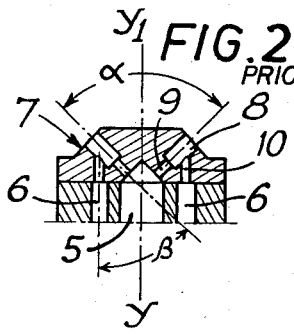
FIG. 3
PRIOR ART
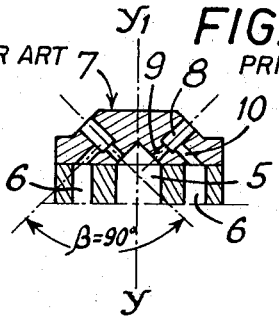
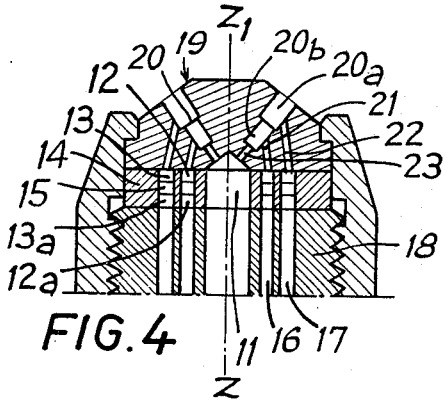
FIG. 4
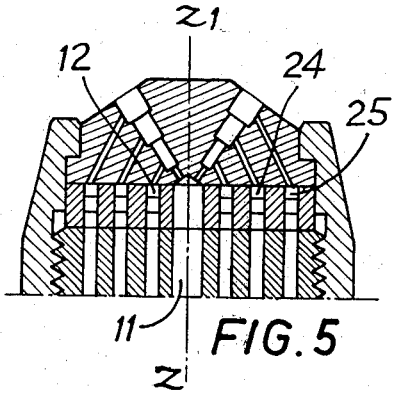
FIG. 5
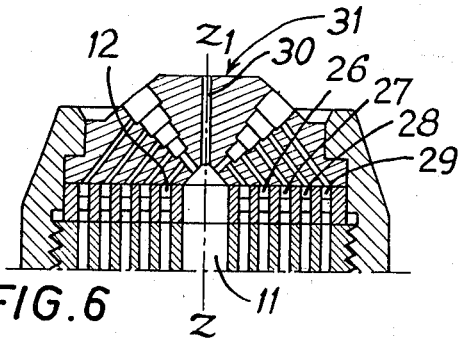
FIG. 6
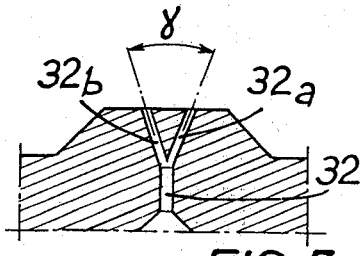
FIG. 7
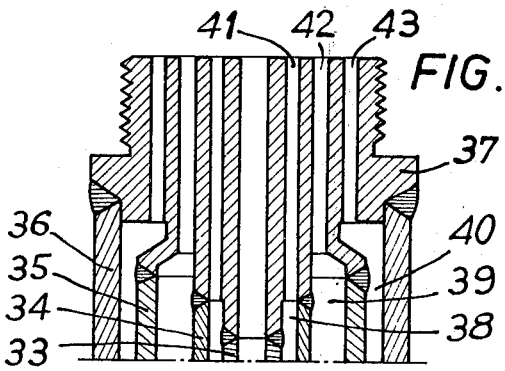
FIG. 8

BURNERS OF LIQUID FUELS ATOMIZED BY THE EXPANSION OF A COMPRESSED AUXILIARY FLUID

The present invention relates to burners of liquid fuels atomized by the expansion of a compressed auxiliary fluid.

The technical field of the invention is that of the construction of atomized liquid fuel burners.

To effect atomization of liquid fuels in order to render them suitable for a good and rapid combustion, it is known to effect said atomization by the mixture, with or without shock, of the liquid fuel and a compressed auxiliary fluid which expands. This auxiliary fluid is, for example, compressed air, water vapour or a compressed gas, that may or may not be combustible.

It is also known to make this mixing in one or more mixing nozzles located in the nose of the burner and opening into the combustion chamber of furnace where combustion is effected.

In each of these mixing nozzles there terminates a nozzle delivering a jet of auxiliary fluid in the course of expansion and a nozzle delivering the liquid fuel which is to be atomized.

The mixing nozzle is generally placed in line with the admission nozzle for the auxiliary fluid. The liquid fuel admission nozzle generally forms an acute angle with the admission nozzle for the auxiliary fluid in order to conserve part of the kinetic energy. However, this angle may be a right angle or even obtuse if it is desired to obtain a better atomization, even at the cost of a pressure drop.

If it is desired to obtain an open flame, a burner nose constituted by a terminal, so-called multi-nozzle, piece, is placed at the head of the pipe of the burner, said terminal piece comprising several mixing nozzles directed along the generatrices of a cone with apex angle $\alpha$ diverging towards the combustion chamber. In this case, the auxiliary fluid is distributed through a central conduit, placed along the axis of the burner, into which open the nozzles injecting the auxiliary fluid into the mixing nozzles.

The liquid fuel to be atomized is distributed through an annular collector, concentric to said central conduit, into which open the fuel nozzles terminating at each mixing nozzle. As before, the angle $\beta$ between the fuel nozzles and the axis common to the auxiliary fluid injection nozzles and to the mixing nozzles may be an acute angle, or a right or even obtuse angle.

The invention has for its object to produce new multi-nozzle burners of atomized liquid fuels, enabling several atomized liquid fuels to be burned simultaneously, allowing progressive passage from one liquid fuel to another, making it possible to inject, at the same time as one or more liquid fuels, liquid or liquefied effluents to destroy them or inject into the flame liquids, for example water, containing in solution or suspension various reactives for improving combustion or for neutralising the fumes.

More generally, it is an object of the invention to produce a liquid fuel burner making it possible to atomize and inject into the flame, simultaneously, at least one second auxiliary liquid which is intimately mixed with the main fuel, this leading either to a good combustion of these liquids if they are combustible, or to a high efficiency if the liquids are intended to improve the combustion of the main fuel.

A burner according to the invention of liquid fuels atomize by the expansion of an auxiliary fluid is composed, in known manner, of a central conduit supplied with auxiliary fluid, a first annular conduit coaxial with said central conduit supplied with liquid fuel, and a multi-nozzle head comprising nozzles which open out into a combustion chamber and which are disposed along a frustum of a cone diverging towards the chamber. Each of these nozzles comprises a mixing chamber into which opens a channel for injection of auxiliary fluid communicating with said central conduit and at least one channel for injection of liquid fuel communicating with said first annular conduit.

The aims of the invention are attained by means of a burner comprising, in addition, supplementary annular conduits, coaxial with said central conduit, each of these supplementary conduits being supplied with an auxiliary liquid and being connected by at least one channel to each of the mixing chambers, so that each nozzle injects into the flame an atomized mixture of said liquid fuel and of at least one auxiliary liquid. These auxiliary liquids may be liquid effluents, combustible or not, which it is desired to destroy in the flame by burning them or decomposing them, for example liquid petroleum products or residue water containing impurities. This may also be water, since it is proved that the injection into the flame of a certain proportion of water, intimately mixed with the liquid fuel, reduces the formation of unburned solids and consequently the deposits of soot, the soiling of heated surfaces and pollution of the atmosphere.

This water may also contain one or more combustion additives in solution or suspension, for example a neutraliser intended for reducing the acidity of the fumes.

These auxiliary liquids may also be constituted by other liquid replacement fuels such as, for example, heavy fuel No. 2, liquid butane, petrol, naphtha, tar, alcohols. This latter case may find applications in the chemical and petrochemical industries and in oil refineries which may have combustible liquid by-products and may thus destroy them whilst recovering the calories.

In a burner according to the invention, each mixing nozzle is divided into as many portions as there are annular conduits, these portions having a section increasing from the centre to the periphery. Each of the portions is connected respectively to one of the annular conduits by at least one pipe.

A burner according to the invention preferably comprises, in addition, a central channel, of small diameter, which opens out at the end of the burner and which communicates with the central conduit for auxiliary fluid, so that the nose of the burner is swept by a jet of auxiliary fluid. This central channel is preferably divided into two or more conduits which diverge towards the nose of the burner and open out at the end thereof.

The result of the invention is a novel burner of atomized liquid fuels.

The advantages of this burner are as follows:

It makes it possible to atomize, by very simple means, one or more auxiliary liquids, at the same time as the main liquid fuel and thus to obtain an intimate mixture. It is already known, for example, to add a certain proportion of water to the fuel to improve combustion and this addition is effected by atomizing an emulsion of water and fuel which was previously formed in an emulsifier. The burner according to the invention enables this prior stage to be eliminated while obtaining a mixture which is just as intimate and efficient.

The burners according to the invention contribute greatly to the fight against nuisances, by the destruction of the liquid or liquefied effluents, which are pollutants or considered as such.

In fact, the intimate mixture of these effluents with the main liquid fuel, in the very divided state, makes it possible to burn said effluents entirely, even if they are not easily combustible. As this reaction takes place in an existing chamber or furnace and as it is exothermic, calories are directly recuperated in the furnace without having to create special installations for destroying the effluents and for recovering the calories. The burners according to the invention also make it possible to destroy or transform into non-polluting residues, liquid effluents which are not combustible but which are transformed on contact with the heat of the flame, particularly water containing residues.

One advantage of the burners according to the invention, which is highly interesting in periods when fuels are in short supply, resides in the fact that it makes it possible to use, simultaneously or successively, several fuels, for example, a main petroleum fuel but also replacement fuels such as alcohols, heavy fuel No. 2 or even liquefield gases such as butane. In particular, in oil refineries, it makes it possible to use liquefied gases as fuels instead of burning them in a flare stack.

A burner according to the invention also enables a liquid to be used as fuel which is not easily inflammable. In this case, combustion is started by means of the main liquid fuel, then, when it is started, the admission of main fuel is reduced or even eliminated.

A further advantage of the burners according to the invention resides in the case in which they enable various liquid agents or solid agents in solution or suspension to be injected into the flame, the purpose of said agents being to improve combustion or reduce noxiousness of the fumes, for example, neutralising agents intended to reduce the acidity of the fumes. Since these agents are very finely divided and intimately mixed with the fuel, they are very regularly distributed in the flame and are highly efficient.

All these results are obtained at a moderate price since the burners according to the invention are easily obtained by slightly modifying the existing multi-nozzle burners, to which it is sufficient to add supplementary conduits by slightly modifying the mixing chambers.

The embodiment comprising three channels disposed at 120° with respect to one another is suitable for a burner of liquid fuel atomized by water vapour, to which it is desired to supply a liquefied gas. This arrangement makes it possible to provide maximum separation of the liquefied gas from the vapour and to avoid evaporation of the liquefied gas before it arrives in the mixing chamber.

The burners according to the invention, comprising a central channel, which is rectilinear or bifurcate, through the multi-nozzle head in order to sweep the terminal face of the burner with auxiliary fluid, are particularly suitable for burners used for destroying liquid effluents containing impurities which involve the risk of being deposited on the head of the burner and clogging it. The sweeping by the auxiliary fluid avoids this clogging.

The invention will be more readily understood on reading the following description given with reference to the accompanying drawings, in which:

FIGS. 1, 2 and 3 are axial sections of prior art burner heads respectively having an axial central nozzle and a side nozzle, both directed into a mixing nozzle, having divergent nozzles centrally fed and side nozzles fed from an annular conduit and extending at an acute angle to the axes of the divergent nozzles and having nozzles like those of FIG. 2 but with the side nozzles extending at right angles to the divergent nozzles;

FIG. 4 is an axial section of a first embodiment of the invention in which the central feed channel supplies fluid to divergent mixing chambers to which a plurality of conduits concentric with the central feed channel supply other fluids;

FIG. 5 is similar to FIG. 4 and illustrates a further embodiment of the invention comprising three conduits for supplying other fluids;

FIG. 6 is similar to FIGS. 4 and 5 and illustrates a further embodiment of the invention comprising five conduits for supplying other fluids and an axial nozzle connected to the central channel;

FIG. 7 is an axial section of a modification of a portion of the burner shown in FIG. 6 to replace the axial nozzle by divergent nozzles;

FIG. 8 is an axial section of a feed pipe for the burner shown in FIG. 5;

Figure 9:
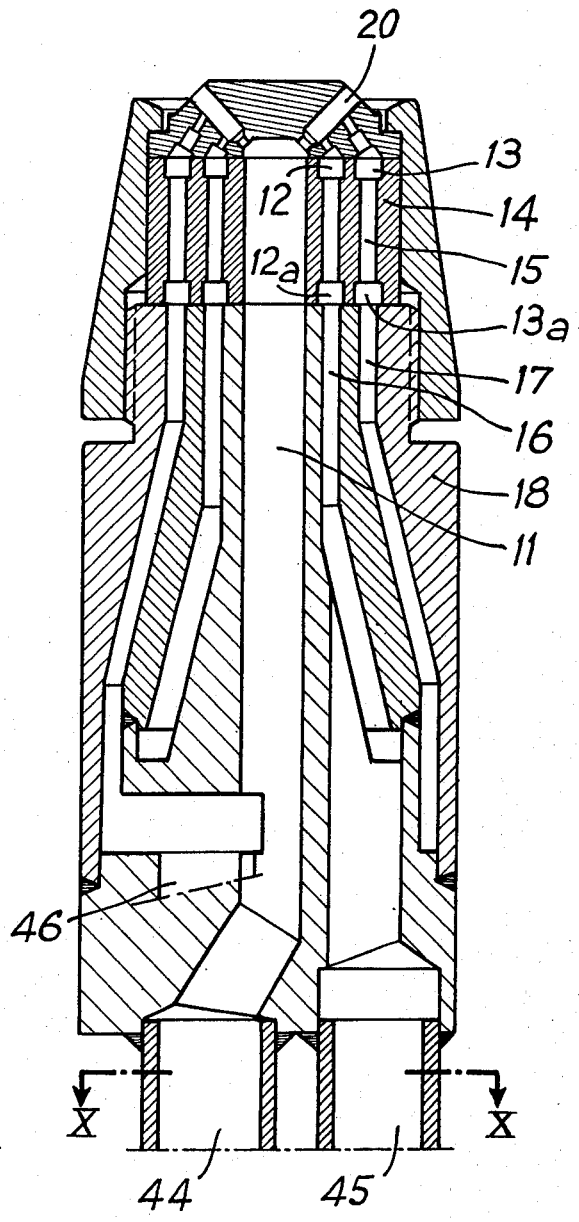
FIG. 9 is an axial section of the combination of the burner of FIG. 4 with a feed pipe.

Referring now to the drawings, FIG. 1 shows a known burner head equipping a burner of liquid fuel atomized by the expansion of an auxiliary fluid. The auxiliary fluid, for example a compressed gas, combustible or not, or water vapour, arrives through the central nozzle 1. The liquid fuel, for example fuel oil, arrives through nozzle 2. Nozzles 1 and 2 open out into a mixing nozzle 3 which itself opens out into a combustion chamber or furnace. The expansion of the auxiliary fluid produces a jet which atomized the liquid fuel and sweeps it along into the chamber.

In this example, the mixing nozzle 3 is situated in line with the auxiliary fluid nozzle 1 and the nozzle 2 forms an acute angle with axis *x–xl* common to nozzles 1 and 3 in order to conserve the maximum of kinetic energy of the two fluids, but this angle could be equal to or greater than 90°.

To obtain an open flame, burner heads of the type shown in FIGS. 2 and 3 are used. These burner heads comprise a terminal piece 7, a so-called multi-nozzle piece, placed at the head of the pipe of the burner.

FIG. 2 shows the end of the burner pipe comprising a central channel, having axis *y–yl*, distributing the auxiliary fluid and an annular conduit 6, having axis *y–yl* distributing the liquid fuel. The multi-nozzle head 7 comprises mixing nozzles 8 which open out into the combustion chamber and are disposed to be along a frustum of a cone having an apex angle $\alpha$, diverging towards the combustion chamber.

Each of these nozzles 8 is connected to a nozzle 9 for injecting auxiliary fluid located in line therewith and opening into the central channel 5 and to a nozzle 10, for injecting liquid fuel opening out into the annular conduit 6. In the case of FIG. 2, the axes of the nozzles 10 form an acute angle $\beta$ with the axes of the nozzles 8 and 9. In the case of FIG. 3, the angles $\beta$ is equal to 90°.

A detailed description of the prior art has been given hereinabove in order clearly to show the changes made to the known burners to make them the burners according to the invention.

FIG. 4 shows a section through the head of a burner, according to the invention, having axis *z–zl*. This burner has a central conduit 11 for the compressed auxiliary fluid and a first annular conduit 12 for the liquid fuel. This burner comprises, in addition, a second annular conduit 13 in which a second liquid circulates.

In this case, the annular conduits 12 and 13 are constituted by circular grooves hollowed out of the front face of a ring 14. These grooves communicate by bores 15 with other grooves 12*a* and 13*a* hollowed out on the other face of the ring 14. The grooves 12*a* and 13*a* communicate with channels 16 and 17 disposed along two concentric circumferences in the pipe 18 of the burner. The burner comprises, in addition, a multinozzle head 19 comprising mixing chambers 20 disposed along a frustum of a cone of axis *z–zl* diverging towards the combustion chamber.

Each chamber 20 is divided into two successive portions 20*a* and 20*b*. Portion 20*a*, nearer the outside, has a section greater than that of the portion 20*b*. The portion 20*b* of each chamber communicates by a channel 21 with the conduit 12. The portion 20*a* communicates via a channel 22 with conduit 13. Each chamber 20 is connected by a channel 23, located in line therewith, to the central conduit 11.

The functioning is as follows:

The compressed auxiliary fluid arriving through channels 23 expands in chambers 20*b* and 20*a* where it meets, on the one hand, the liquid fuel delivered through channels 21 and on the other hand the second liquid delivered through channels 22. These two liquids are atomized by the jet of auxiliary fluid and form an emulsion of droplets of liquid in the gas. Of course, the admission of the liquid fuel and of the second liquid could be reversed.

The ratio between the flow of liquid fuel and the flow of the second liquid may be regulated by any of the means known to the man skilled in the art, from the flow of fuel only, to the flow of the second liquid only, in the case where, the maintenance temperature of the combustion being attained, just the heat produced by the second liquid may suffice to maintain said temperature.

The flows of the liquid fuel and the second liquid may also be regulated automatically, by installing on each circuit a flow or pressure regulator means. The desired control of pressure variation may, for example, be realised in the different flow paths by a cam regulator device or like system.

The second liquid may for example be a liquid effluent, combustible or not, which it is desired to destroy or transform in the flame of the burner.

The burner of FIG. 4 may also be used for injecting into the flame a certain proportion of water which reduces the formation of the unburned solids and, consequently, the soiling of the heated surfaces and the often visible pollution due to the exhaust of the fumes into the atmosphere.

In this case, conduits 17 and grooves 13 and 13*a* of FIG. 4 serve for the injection of water.

The water thus injected may also be charged with certain reagents which improve combustion or reduce the corrosiveness of the fumes, for example, a liquid product or a pulverulent product, in solution or in suspension in water. For example, a neutralising product may be added to the water which reduces the acidity of the fumes, or any other reagent. The burner used remains the same but the water-reagent mixture is, in this case, effected previously outside the burner.

The burners according to the invention also make it possible to inject into the flame several products reacting on one another or on the fuel, this being in addition to the main fuel, the auxiliary atomizing fluid, one or more effluents and water containing a reagent or not.

The number of flow-paths is then increased, this leading to the burners shown in FIGS. 5 and 6.

The burner of FIG. 5 comprises, in addition to the central conduit 11 for auxiliary fluid and the annular conduit 12 for main fuel, two other annular conduits 24 and 25 enabling two other liquids to be injected simultaneously.

The burners according to the invention may be fed simultaneously or separately with various fuels such as, for example, heavy fuel No. 2, liquid butane, low-boiling gasolene, naphtha, various tars, various alcohols.

Such burners are of great interest for burners used in heat generators installed in chemical or petrochemical factories or in the petroleum industry which have combustible liquid by-products.

For such applications, burners may be made according to the invention which comprises larger number of separate flow paths, each being supplied with one of the liquids entering, permanently or discontinuously, in the general combustion reaction.

FIG. 6 shows a burner comprising, for example, in addition to the central circuit 11 for the auxiliary fluid and the circuit 12 for the main fuel, four other conduits 26, 27, 28 and 29 enabling up to four supplementary liquids in addition to the main fuel to be atomized. The mixing chambers comprise four successive portions of sections increasing from the centre to the outside.

The burner of FIG. 6 comprises, in addition, a central channel 30, of small diameter, which communicates with the central conduit 11 and which opens out at the end of the burner, so that the terminal face 31 of the burner is swept by a jet of auxiliary fluid, for example water vapour, this avoiding soiling in the case of certain of the liquids, for example, effluents containing impurities; this would entail the risk of deposits on the front face 31.

FIG. 7 shows, on a larger scale, another embodiment of the head of a burner comprising a central channel 32 which is divided into two channels 32*a* and 32*b* forming angle $\gamma$ therebetween. Of course, this example is not limiting and there may be more than two channels. This embodiment is particularly efficient for burners consuming residual products that may give rise to considerable deposits, whatever the number of flow paths used.

FIG. 8 shows by way of example a longitudinal section through the end of a burner pipe corresponding to the head of FIG. 5. This pipe is composed of concentric tubes 33, 34, 35, 36 connected to a body 37 and defining between them annular spaces 38, 39, 40 which communicate with circular rows of holes 41, 42, 43 made through the body 37. These rows of holes communicate with the grooves 12, 24, 25 of FIG. 5.

If the liquid products subject to the risk of evaporating, when passing through the pipe, under the effect of heating by the water vapour used as auxiliary fluid, as is the case if a liquefied gas, such as butane, is used as secondary fuel, it is preferable not to use a pipe comprising concentric tubes which promote heat exchange.

Figure 10:
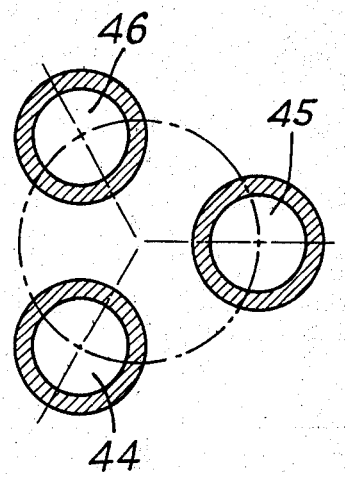
FIG. 10 is a cross-section of the feed pipe of FIG. 9 taken along the line X—X shown in FIG. 9.

FIG. 9 shows a part section through the end of a pipe feeding a burner head according to FIG. 4. FIG. 9 shows the ring 14 again, comprising grooves 12 and 13 communicating with grooves 12*a* and 13*a* via channels 15. The grooves 12*a* and 13*a* communicate with the channels 16 and 17 made in the piece 18. On the piece 18 are connected three tubes 44, 45 and 46 communicating respectively with the channels 11, 16 and 17. These three tubes are disposed at the three apices of an equilateral triangle so that they have no point of contact between them and that the heat exchanges are reduced. FIG. 10 is a section through FIG. 9 along X—X showing the three tubes 44, 45 and 46 disposed at 120° with respect to one another.

In one or the other of the embodiments of the pipe of the burner, with concentric or separated tubes, the number of circuits flow paths may be unlimited.

What we claim is:

1. A burner of liquid fuels atomized by the expansion of a compressed auxiliary fluid, said burner being composed of:

a central conduit fed with auxiliary fluid, a first annular conduit, coaxial with said central conduit, fed with a liquid fuel, a multi-nozzle head comprising nozzles which open out into a combustion chamber and which are disposed along a frustum of a cone diverging towards said chamber, each of these nozzles comprising a mixing chamber into which opens a channel injecting auxiliary fluid communicating with said central conduit and at least one channel injecting liquid fuel communicating with said first annular conduit, which burner comprises, in addition, supplementary annular conduits, coaxial with said central conduit, each of these supplementary conduits being fed with an auxiliary liquid and being connected by at least one channel to each of the mixing chambers, so that each nozzle injects into the flame an atomized mixture of said liquid fuel and of at least one auxiliary liquid.

2. A burner as claimed in claim 1, wherein each mixing chamber is divided into as many portions as there are annular conduits and the successive portions have a section which increases from the center of the burner to the periphery and are each connected respectively to one of said annular conduits by at least one channel.

3. A burner as claimed in claim 1 comprising one supplementary annular conduit which is disposed about said first annular conduit and which is fed with a liquid belonging to the following group of liquids; liquid effluents, combustible or not, intended to be destroyed in the flame; auxiliary liquid fuels; water; aqueous solutions and suspensions containing a reagent.

4. A burner as claimed in claim 1, comprising in addition a ring, placed immediately to the rear of said multi-nozzle head, which ring comprises a central bore which communicates with said central channel and comprises, in addition, on each of its side faces, circular grooves of the same diameter concentric with said central bore, which are connected in two's by axial bores, each pair of grooves connected together forming part of one of said annular conduits.

5. A burner as claimed in claim 4, of which each ring comprises a central bore and two pairs of concentric grooves, which burner is placed at the end of a pipe which comprises three channels disposed at the three apices of an equilateral triangle, one of these channels communicating with said central bore and each of the other two channels with one of the two grooves located on the face of said ring opposite the multinozzle head.

6. A burner as claimed in claim 1, wherein said multinozzle head is pierced with a central channel, of small diameter, which communicates with said central conduit and which opens out at the end of the burner so that the terminal face of the nose of the burner is swept by a jet of auxiliary fluid.

7. A burner as claimed in claim 6, wherein said central channel is divided into a plurality of channels with diverge towards the nose of the burner and open out at the end thereof.

* * * * *

UNITED STATES PATENT OFFICE
CERTIFICATE OF CORRECTION

PATENT NO. : 4,002,297
DATED : January 11, 1977
INVENTOR(S) : Jean-Claude L. Pillard It is certified that error appears in the above-identified patent and that said Letters Patent are hereby corrected as shown below:

| | |
|---|---|
| Col. 1, line 20 | "of" should read -- or-- |
| " 2, line 2 | "atomize" should read --atomized-- |
| " 3, line 26 | "liquefield" should read --liquefied-- |
| " " line 35 | "case" should read --ease-- |
| " 4, line 40 | "atomized" should read --atomizes-- |
| " " line 57 | "be" should read --lie-- |
| " 6, line 25 | "comprises" should read --comprise a-- |
| " 7, line 15 | delete "circuits" |
| " 8, line 38 (Claim 7) | "with" should read --which-- |

Signed and Sealed this
Twenty-ninth Day of March 1977

[SEAL]

*Attest:*

RUTH C. MASON
*Attesting Officer*

C. MARSHALL DANN
*Commissioner of Patents and Trademarks*